252-95 AU 166 EX
12/19/78 XR 4,130,392

United States Patent [19] [11] 4,130,392
Diehl et al. [45] Dec. 19, 1978

[54] BLEACHING PROCESS

[75] Inventors: Francis L. Diehl, Wyoming; James B. Edwards, Roselawn, both of Ohio

[73] Assignee: The Procter & Gamble Company, Cincinnati, Ohio

[21] Appl. No.: 630,237

[22] Filed: Nov. 10, 1975

Related U.S. Application Data

[63] Continuation of Ser. No. 437,569, Jan. 29, 1974, abandoned.

[51] Int. Cl.[2] ..... D06L 3/02; D06L 3/04
[52] U.S. Cl. ..... 8/101; 8/111; 34/133; 252/95
[58] Field of Search ..... 8/111, 101; 34/133, 34/12-74; 252/95

[56] References Cited

U.S. PATENT DOCUMENTS

| | | | |
|---|---|---|---|
| 3,180,037 | 4/1965 | Kenreich et al. | 34/37 |
| 3,701,202 | 10/1972 | Compa et al. | 34/72 |
| 3,775,332 | 11/1973 | Heins et al. | 252/95 |
| 3,945,936 | 3/1976 | Lucas et al. | 252/95 |

OTHER PUBLICATIONS

Shanley, E. S. et al., The $H_2O_2$ Drying Process for Bleaching Wool, Amer. Dyestuff Reporter, vol. 40, No. 1, pp. 1-4, Jan. 8, 1951.

*Primary Examiner*—William E. Schulz
*Attorney, Agent, or Firm*—Jerry J. Yetter; Richard C. Witte; Julius P. Filcik

[57] ABSTRACT

Contacting damp fabrics with a dry, activated bleaching composition in an automatic dryer results in improved bleaching and stain removal over dry bleaching compositions employed in an aqueous laundering bath.

8 Claims, No Drawings

BLEACHING PROCESS

This a continuation, of application Ser. No. 437,569, filed Jan. 29, 1974 is now abandoned.

BACKGROUND OF THE INVENTION

The present invention encompasses fabric bleaching compositions and processes adapted for use in an automatic dryer. More specifically, the process herein employs a solid, substantially dry, activated peroxygen bleach composition in an automatic clothes dryer to remove stains from fabrics. The bleach compositions are formulated to provide the requisite solubility in the limited amount of water available from the damp fabrics which are being dried.

Fabric treating processes and compositions designed to provide desirable functional and aesthetic benefits to fabrics are conventionally employed in a washing machine. Thus, fabric sizings and softening agents, fabric bleaches and brighteners, and the like, are most commonly formulated and provided as compositions designed for use either in an aqueous laundering liquor or in an aqueous rinse bath. More recently, the treatment of fabrics in an automatic clothes dryer has been shown to be an effective means for imparting desirable properties thereto. For example, it is becoming common to soften fabrics in an automatic clothes dryer rather than during the rinse cycle of a laundering operation.

U.S. Pat. No. 3,701,202 discloses a dispensing means for use in an automatic clothes dryer and suggests that fabrics may be softened, bleached, and otherwise desirably treated in the dryer. However, this patent relates only to a useful dispenser for fabric treatment compositions and does not disclose operable compositions which can be employed therein. U.S. Pat. No. 3,180,037 discloses a modified bleaching/drying apparatus.

The most familiar method for bleaching fabrics to remove stains, especially in the context of a home laundering operation, is to add an oxidizing bleach directly to the laundering liquor. Liquid hypochlorite solutions are most commonly employed, but solid peroxygen bleaches are also commerically available. Such bleaches are designed for addition to the laundering bath in conjunction with the detergent, and provide the desired bleaching action concurrently with fabric laundering.

While through-the-wash bleaching processes are effective in most instances, they do suffer from several inherent drawbacks. For example, the addition of either liquid or solid bleaches to the 10–21 gallons of water normally employed in an automatic washing machine substantially dilutes the bleach, thereby reducing its effectiveness. For this reason, the quantities of bleach employed in the laundering bath must necessarily be high to overcome the dilution effect. Moreover, certain stains can actually be "set" by oxidizing bleaches when used in combination with a detergent in an aqueous laundering bath. For example, blood stains and mineral stains can be darkened by some oxidizing bleaches and become more tenaciously affixed to the fabrics. In such instances, it is more desirable to remove these kinds of stains by washing in the absence of bleach, and to complete the laundering operation by a later bleaching step. Additionally, many oxidizing bleaches contain ingredients which are not compatible with certain components of laundry detergents. Undesirable interactions can ensue when such bleaches and detergents are commingled in the laundering liquor.

From the foregoing, it is seen that it would be desirable to provide a means whereby the bleach user could conveniently and effectively bleach fabrics other than in an aqueous laundering liquor.

It has now been found that solid bleaches, especially peroxygen bleaches, can be employed in the manner disclosed more fully hereinafter to bleach fabrics in an automatic clothes dryer. In a preferred mode, solid peroxygen bleaches are activated by means of certain additives and employed in an automatic dryer to provide substantial bleaching superiority over dry bleaching compositions employed in a laundering liquor.

Accordingly, it is an object of the present invention to provide compositions and processes designed to achieve through-the-dryer fabric bleaching.

It is another object herein to provide dryer-bleaching compositions especially adapted for use in conjunction with the limited amount of water available as a reaction medium in an automatic clothes dryer.

These and other objects are obtained herein as will be seen from the following disclosure.

SUMMARY OF THE INVENTION

In its broadest aspect, the present invention encompasses a process for removing stains from fabrics in an automatic dryer comprising commingling pieces of damp fabric by tumbling said fabrics under heat in a clothes dryer together with an effective amount of a particulate bleaching composition.

In a preferred mode, the bleaching composition is employed in the dryer in a dispensing means which provides even, yet rapid, distribution of the bleach particles over all fabric surfaces. A preferred bleaching article used in the present process comprises a bleaching composition releasably contained in a porous polyurethane pouch, as more fully described in the concurrently filed application of Lucas, McKenna and Diehl, Ser. No. 437,570 now U.S. Pat. No. 3,945,936 the disclosures of which are incorporated herein by reference.

DETAILED DESCRIPTION OF THE INVENTION

The bleaching process of the present invention is carried out by contacting damp fabrics with an effective amount of a solid, powdered bleaching composition of the type described hereinafter. It is an essential feature of the present process that the fabrics to be bleached be damp when contacted by the bleaching composition, inasmuch as water provides the reaction medium in which the bleaching process occurs. Accordingly, the bleaching compositions employed herein must have some solubility in water. Moreover, the compositions herein are provided as finely divided particles having an average diameter ranging up to about 200 microns ($\mu$), preferably have a diameter of from about 25$\mu$ to about 175$\mu$, most preferably 100$\mu$ to about 150$\mu$. The small particle size of the bleaching compositions provides rapid dissolution in the limited amount of water present in the damp fabrics. Such rapid dissolution is preferred, since the water is constantly being removed from the fabrics by the action of the dryer.

The bleaching compositions employed in the present process are specifically formulated to bleach and remove stains from fabrics in an automatic clothes dryer. Non-limiting examples of such compositions are as follows.

BLEACHING COMPOSITION

The bleaching compositions employed herein can be any of a variety of solid, water-soluble materials known in the art to be safe and effective for removing stains from fabrics. The solid peroxygen bleaches are preferred for use over chlorine bleaches, inasmuch as peroxygen bleaches are less likely to damage fabric dyes. Mixtures of bleaches and bleach/activator mixtures can also be employed as the bleaching compositions herein.

Peroxygen bleaches useful herein include the common inorganic peroxy-compounds such as the alkali metal and ammonium perborates, percarbonates, monopersulfates and monoperphosphates. It is well-known that these inorganic peroxygen bleaches exist as various hydrates, but the degree of hydration is not important to the practice of the present invention. Examples of these peroxygen bleaches include the sodium and potassium perborates, the sodium and potassium percarbonates, and complex per-salts such as $KHSO_4 \cdot K_2SO_4 \cdot 2KSO_5$, marketed under the tradename *Oxone*. The water-soluble perborates, especially in combination with an activator, are particularly preferred herein on the basis of bleaching performance, fabric safety and availability.

Solid, water-soluble organic peroxy acids, or the water-soluble, e.g., alkali metal, salts thereof of the general formula

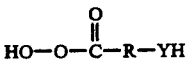

wherein R is a substituted or unsubstituted alkylene or arylene group and Y is

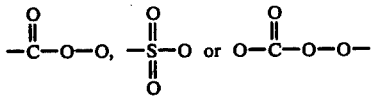

or any other group which yields an anionic group in aqueous solution are useful herein. These organic peroxy acids and their use in combination with activators as highly water-soluble, micellar bleaches are more fully described in U.S. Pat. No. 3,749,673, incorporated by reference.

The mixtures of organic peroxy acids and persulfate bleaches described in U.S. Pat. No. 3,773,673, incorporated herein by reference, are also highly water-soluble and useful in the present invention.

The above peroxygen bleaching compounds and mixtures can be used singly herein to bleach fabrics. However, various bleaching activators can be advantageously employed to enhance bleaching performance. The use of such activators is especially preferred when the inorganic peroxygen bleaches are employed in the bleaching composition herein. While not intending to be limited by theory, the need for such activators arises due to the relatively short time available for effective bleaching in the automatic dryer. The bleaching compositions useful in an automatic dryer are designed to act while there is sufficient water remaining on the fabrics to provide a reaction medium in which the bleaching reaction can occur. Accordingly, any means whereby the bleaching composition is made more readily soluble and reactive in the limited amount of available water is of advantage in a through-the-dryer bleaching composition.

Inorganic peroxygen bleaches can be employed in combination with various solid activators and used as the bleaching compositions herein. Suitable activators for a wide variety of inorganic bleaches are set forth in U.S. Pat. No. 3,130,165, incorporated herein by reference. In particular, such activators include various esters of phenols or substituted phenols with alpha-chlorinated lower aliphatic carboxylic acids, such as chloracetic acid or alpha-chloropropionic acid, said esters containing no ester group of any acid other than alpha-chlorinated lower aliphatic carboxylic acids.

The alkali metal perborates, especially sodium perborate, and ammonium perborate constitute a preferred, safe and effective class of bleaches herein when used in combination with an activator. Many perborate bleaching activators are known in the art. Materials such as the acylphosphonic acid esters, N,N'-diarylsulphamides, carboxylic acid anhydrides, N-acylamides, N-acylated heterocycles, acylhydroxylamines and other like compounds which readily acylate the peroxy compounds are well-recognized perborate activators.

Included among such perborate activators are tetraacetyl methylenediamine, acetyl esters of sodium phenol sulfonate, chloroacetylsalicylic acid, 1-phenyl-3-acetyl hydantoin, tetraacetyl ethylenediamine, α-D-glucose pentaacetate, p-phenylene diacetate, tris-(acetyl) cyanuric acid, N-methyl-N-benzoyl-p-toluene sulfonamide, benzoyl chloride, and N-benzoyl imidazole. Other perborate activators are listed in U.S. Pat. Nos. 3,177,148 and 3,779,931, incorporated herein by reference.

A most highly preferred perborate activator herein is 1,3,4,6-tetra-acetyl glycouril, abbreviated TAGU. TAGU can be prepared in the manner set forth in Henkel Referate 1973 (8), 28–33.

It is to be recognized that other solid, water-soluble bleaching compositions suitable for use herein can be prepared by admixing inorganic and organic bleaches. Examples of such mixed bleaches include sodium perborate/p-methoxyperbenzoic acid, and the like. Such mixed bleaches can optionally be activated, for example, by TAGU.

The activated bleaching compositions herein can contain the activator in either catalytic amounts or in proportions of bleach:activator which are more nearly stoichiometric ratios. As noted above, many perborate activators appear to function by an acylation reaction and are not catalytic in the accepted sense of that term. In such instances, it is well-recognized that sufficient activator is employed to satisfy the stoichiometric requirements of the bleaching reaction.

A preferred bleaching composition for use herein comprises sodium perborate and TAGU at a weight ratio of perborate:TAGU of from about 1:3 to about 30:1. A highly preferred bleach composition comprises from about 1 part to about 10 parts by weight of sodium perborate and from about 2 parts to about 1 part by weight of TAGU.

OPTIONAL COMPONENTS

The fabric bleaching compositions herein can optionally contain minor proportions (i.e., 0.1% to about 15% by weight) of various ingredients which provide additional fabric conditioning benefits. Such optional ingredients include perfumes, anti-static agents, fumigants, bactericides, fungicides, optical brighteners, and the like. Specific examples of typical solid, water-soluble additives useful herein can be found in any current Year Book of the American Association of Textile Chemists and Colorists. Such additional components can be selected from those compounds which are known to be compatible with the bleaches and activators employed herein, or can be coated with water-soluble coatings such as solid soaps, and the like, and thereby rendered compatible.

Useful optional ingredients herein include $C_8$–$C_{20}$ amines, imidazolines, and quaternary ammonium salts widely recognized for use as fabric softening and antistatic agents. Specific examples of such materials include the mixed tallow-alkyl amines, di-tallowalkyldimethylammonium chloride, and the like.

The water-soluble silicate materials recognized in the art as corrosion inhibitors can be advantageously employed in the present compositions at levels of about 5% by weight.

The water-soluble, solid optical brighteners, especially bis-(styrylsulfonate)biphenyl, can advantageously be employed in the present compositions to provide an added brightening effect on the bleached fabrics.

It will be recognized that any of the foregoing types of optional components can be provided in a solid, particulate form which can be dispensed onto the damp fabrics concurrently with the bleaching composition herein to provide the desired additional fabric treatment benefits.

The compositions herein can be simply sprinkled onto the fabrics to be bleached. In a preferred mode, the compositions herein are evenly, yet quickly dispensed onto the fabrics to be bleached in the dryer by a dispensing means. A preferred dispensing means comprising a receptacle for the bleaching composition, which, in combination with the bleaching composition, comprises a bleaching article designed for convenient and effective use in an automatic dryer. Receptacles which are useful as bleach dispensers in an automatic dryer are described more fully hereinafter.

RECEPTACLE

The article herein comprises a water-insoluble, closed receptacle containing within its cavity a bleaching composition. The receptacle has at least one opening in its walls through which the bleaching composition is released. Inasmuch as the receptacle is to be used in an automatic dryer, it is comprised of a heat resistant material, or a material which can be rendered heat resistant at dryer operating temperatures. Moreover, the receptacle is fashioned from a material which is resistant to oxidation by the bleaching composition contained therein, both at ambient and dryer operating temperatures. Since the article is designed for use in contact with damp clothing, it is made from a water-insoluble material. The receptacle herein can be made from open-weave cotton, polyester, and the like, cloth. The open-weave structure can be chosen to provide controlled release of the bleaching composition.

Preferred receptacles for use herein are fashioned from cellular foam materials having a plurality of passages from inner to outer surfaces. Such foams are known in the art as "open pore" or "open cell" foams, and have a large proportion of cells which are interconnected, thereby providing passageways, or "pores," through the interconnecting cells. Open pore foams are distinguished from "closed pore" cellular foams in which the closed pore structure substantially isolates the individual cells.

Open pore foams can be made from polystyrene, polyurethane, polyethylene, poly-(vinyl chloride) cellulose acetate, phenol-formaldehyde and other foamed polymeric materials such as cellular rubber. Many of these foams and their method of manufacture are disclosed in standard references such as the *Encyclopedia of Polymer Science and Technology,* Interscience Publishers, John Wiley & Sons, Inc. (1965), incorporated herein by reference.

Preferred materials for preparing the receptacles herein are open pore polyurethane foams widely known in the art. The open pore polyurethanes are resistant to heat, oxidation and water, and can be prepared in a variety of pore "sizes." The preparation of many recently developed foams is described in the text, *Cellular Plastics Recent Developments* (1970), Johnson, Noyes Data Corporation and in the *Encyclopedia of Polymer Science and Technology,* supra. In general, urethane foams are prepared by polymerizing diisocyanates and hydroxyl-terminated polyethers or polyesters. Foaming is accomplished by including water and optional foaming agents in the reaction system, and the reaction between the isocyanate and water releases carbon dioxide gas which foams the polymer.

The foamed receptacles herein provide controlled release of the particulate bleaching composition during the drying cycle. The controlled release insures uniform and measured dispensing of the bleaching composition onto the surfaces of all fabrics within the dryer. More specifically, during the drying operation the bleaching composition sifts through the plurality of passages in the walls of the receptacle. This sifting action is facilitated by the tumbling action of the dryer.

Water is required to provide a reaction medium for the bleaching composition, and the porosity of the receptacle is selected so that the bleaching composition is substantially all released from the receptacle before all the water is evaporated from the fabrics. Moreover, it is preferred that the bleaching composition be released rapidly, but uniformly, during the early stages of the drying cycle when sufficient water is present on the fabrics to dissolve the bleaching composition. If the bleach is dispensed onto the substantially dried clothes late in the drying cycle, it is either lost by venting from the dryer, or can appear as undesirable dust on the dried fabrics.

The preferred receptacles herein release the particulate bleaching composition during the first one-quarter of the drying cycle, when the fabrics are still quite damp. In conventional home dryers, this preferred period comes within the first 10 minutes to 15 minutes of the drying cycle.

BLEACHING PROCESS

The process herein is carried out in the following manner. Damp fabrics, usually containing from about 1 to 1.5 times their weight of water, are placed in the drum of an automatic clothes dryer. In practice, such damp fabrics are commonly obtained by laundering, rinsing and spin-drying in a standard washing machine. The bleaching composition herein is simply spread uniformly over all fabric surfaces, for example, by sprinkling the composition onto the fabrics from a shaker device. The dryer is then operated in standard fashion to dry the fabrics, usually at a temperature of from about 50° C. to about 80° C. for a period of from about 10 minutes to about 60 minutes, depending on the fabric load and type.

The bleaching process of the present invention is carried out using an effective amount of the bleaching compositions of the type described above. By an "effective amount" of the bleaching composition herein is meant an amount sufficient to bleach the stains from an average load of fabrics in an automatic dryer. Of course, the actual amount of the bleaching composition employed will depend on the fabric load, the amount of stain to be removed, and the bleaching composition selected for use. For an average 5 lbs. to 8 lbs. load of medium-to-heavily stained fabrics, from about 10 grams to about 50 grams, preferably 20–30 grams, of bleaching composition suffice to provide good stain removal.

In a preferred mode, the present process is carried out by fashioning a bleaching article comprising a receptacle of the type hereinabove described containing an effective amount of the bleaching composition. The bleaching article is simply added to clothes dryer together with the damp fabrics to be bleached. The tumbling action of the revolving dryer drum evenly distributes the bleaching composition over all fabric surfaces.

A preferred article useful in the present process is one wherein the rate of release of the bleaching composition is optimized. The rate of release should not be so fast that the bleach is deposited in an uneven manner on the fabrics. Conversely, the rate of release of the bleaching composition from the receptacle must not be too slow, since all, or substantially all, of the bleach is preferably dispensed onto the fabrics while they are still damp. The rate of release of the bleaching composition depends on both the porosity of the openings in the receptacle and the particle size of the bleaching composition. Of course, the average diameter of the particles of bleaching composition must be somewhat smaller than the average pore diameter of the porous openings in the receptacle to achieve release. Moreover, the bleaching compositions of the present invention are employed as fine powders or dusts which rapidly dissolve in the limited amount of water available in the damp fabrics. Bleaching compositions having an average particle diameter below about 200μ, and preferably falling in the range from about 25μ to about 175μ are rapidly dissolved in water and are preferred for use herein. Accordingly, receptacles having a pore diameter somewhat larger, ca. 5%–10% larger, than the particle diameter of the bleaching compositions provide controlled, even release.

Preferred articles herein are fashioned from open pore polyurethane foam receptacles. The polyurethane foams employed herein can be defined in terms of average pore diameter, and polyurethane foams having rigorously controlled pore sizes are commercially available. However, such materials are quite expensive as compared with the common open pore polyurethanes having mixed pore diameters. The common open pore polyurethanes are more often characterized in terms of their density in lbs./cu.ft. The density of polyurethane foams depends almost wholly on the size of the void spaces therein, and these void spaces are fairly regular in size. Accordingly, by designating the density of the polyurethane foams employed herein, the pore sizes are necessarily defined. Open pore polyurethane foams having a density of from about 0.75 lbs./cu.ft. to about 1.5 lbs./cu.ft. are useful herein.

In addition to the density of the polyurethane foam and the particle size of the bleaching compositions herein, the thickness of the polyurethane foam will affect the rate of dispensing. It is preferred that the bleaching composition be substantially completely dispensed onto the damp fabrics within the first 10–15 minutes of the drying cycle. Polyurethane foams having a density from about 0.75 lbs/cu.ft. to about 1.5 lbs./cu.ft. and a thickness of from about 0.10 in. to about 0.50 in. when used in combination with bleaching compositions having the above-described particle sizes, provide this preferred rate of release.

The dispensing receptacles which are conveniently used in the present process can be provided in a variety of sizes and shapes, and the particular configuration of the receptacle is not critical to the practice of the invention. For example, the receptacle herein can be provided wherein only one wall, or a portion of one wall, comprises a porous opening through which the bleaching composition is dispensed. Preferably, the whole of the receptacle comprises a porous material through which the bleaching composition sifts in a manner akin to a rosin bag.

The simplest and most highly preferred bleaching article used in the present process employs the dispensing receptacle in the form of a pouch. Preferred receptacles herein comprise an open pore polyurethane foam pouch containing the bleaching composition. The pouch is formed by folding the polyurethane sheet into the desired pouch or pouch-like configuration and sealing the edges, for example by heat-sealing. The bleaching composition is added through the pouch by the top opening, and the opening is then sealed. The resulting pouch is found to release the bleaching composition through its porous walls upon agitation, e.g., by the tumbling action of an automatic dryer.

In a highly preferred mode of the present process, stains are removed from damp fabrics in an automatic dryer by commingling said damp fabrics under heat in a clothes dryer together with a dispensing means comprising a water-insoluble, closed, open pore polyurethane pouch having a density of from about 1.1 lbs./cu.ft. to about 1.30 lbs./cu.ft. and a thickness of from about 0.15 in. to about 0.35 in., said pouch containing a bleaching composition consisting essentially of a mixture of sodium perborate and TAGU, said bleaching composition having an average particle diameter below about 150μ.

The following examples illustrate the present invention but are not intended to be limiting thereof.

EXAMPLE I

| Bleaching Composition | |
|---|---|
| Ingredient | Wt. % |
| Sodium perborate | 66.67 |
| TAGU* | 33.33 |

*As defined hereinabove

The sodium perborate was screened through a 100 mesh screen (149μ) and the coarse particles which did not pass through the screen were discarded.

The bleaching composition was prepared by admixing 18.67 grams of the screened perborate and 9.33 grams of TAGU. The resulting bleaching composition had an average particle size below about 150μ.

The bleaching composition prepared in the foregoing manner was placed in a polyurethane (density 1.2 lbs./cu.ft.) pouch formed from a piece of open pore polyurethane 7 in. × 5 in. The polyurethane was ¼ in. thick. This bleaching article was employed in a through-the-dryer bleaching operation and compared with commercial bleaching compositions employed in a standard through-the-wash bleaching operation.

The testing procedure used to evaluate the bleaching process employing the pouch article of Example I was as follows. Five lbs. of terry wash cloths were placed in a Kenmore Washer, Model 110, together with eight uniform (5.0 in. × 5.0 in.) cotton cloth swatches stained with standardized tea, coffee and brown gravy stains. The stained swatches were intermingled with the terry wash cloths prior to washing to simulate the type of treatment that would be encountered in a standard washing procedure involving patches of heavy stain on clothing. In the test procedure, four swatches were stained with tea, two with coffee and two with brown gravy. The washer was operated under the manufacturer's suggested operating conditions using 17 gallons of wash water of 7 grain hardness at a temperature of about 125° F. in the wash cycle. 70 Grams of a standard commercial built anionic detergent composition were employed to launder the fabrics. Four separate washer runs, denoted as Runs A through D were made.

In Run A, a chlorine bleach was added to the rinse cycle through a bleach dispenser in the manner recommended by the manufacturer. The commercial bleach was employed at a concentration of 200 ppm of available chlorine.

In Run B, 103 grams of a commercial sodium perborate bleaching composition were added to the laundering liquor in accordance with the washer manufacturer's recommended procedure. This amount of bleaching composition was calculated to provide 55 ppm of available oxygen in the wash liquor.

Runs C and D involved only laundering, rinsing, and spin-drying the fabric bundle, without added bleach.

The fabric bundles of Runs A, B and C were dried in a standard commercial dryer using the manufacturer's recommended procedure.

The spun-dried, damp fabrics of Run D were placed in a commercial dryer together with the article of Example I. The fabrics were dried according to the manufacturer's operating instructions.

The standard stain swatches were separated from the terry towels and their degree of whiteness was evaluated using a Hunter Color and Color Difference Meter, in combination with a Roland, Robinson readout device (Model AS/026), and the L, a and b values thereby obtained were substituted in the whiteness equation derived in a manner analogous to the whiteness equation in the article by F. Diehl, "A Single Number Expression for Whiteness Evaluation of Washed Fabrics," in *Proceedings of the IV International Congress on Surface Active Substances*, Brussels, 7–12 Sept., 1964, vol. III, section C of the Congress, incorporated herein by reference.

This whiteness equation, $$W = 100 - \left((100-L)^2 + 1.44\,[(a-4.1)^2 + (b+8.0)^2]\right)^{\frac{1}{2}}$$

is especially adapted for modern fabrics with fluorescent whitening agents.

The bleaching results from the test are set forth in Table I. The higher the number in the table, the more efficient is the bleaching. Two units on the Diehl scale have been shown to be visually recognizable by the average observer.

TABLE I

| | Coffee | Brown Gravy | Tea | 3 Stain Average |
|---|---|---|---|---|
| Run A | 9.0 | 6.9 | 18.9 | 11.6 |
| Run B | 3.5 | 1.4 | 2.9 | 2.6 |
| Run C (control) | 0 | 0 | 0 | 0 |
| Run D (Dryer Bleach) | 8.6 | 2.5 | 9.7 | 7.0 |

As can be seen from Table I, Run D, involving the dryer added bleach employed in the manner of this invention, provides more effective stain removal than a commercial perborate bleach employed in an aqueous laundering liquor. Moreover, the bleach herein compared favorably with a commercial chlorine bleach used in an aqueous medium.

EXAMPLE II

| Bleaching Composition | |
|---|---|
| Ingredient | Wt. % |
| Sodium perborate | 65 |
| TAGU | 32.5 |
| bis-(styrylsulfonate)biphenyl* | 0.7 |
| Perfume | 1.7 |

*Optical Brightener

The sodium perborate (as the commercial tetrahydrate) is screened through a 100 mesh screen and the particles which are too large to pass through the screen are discarded. The TAGU, sodium perborate, optical brightener and perfume are dry-mixed and sieved through a second 100 mesh screen to provide a bleaching composition having an average particle diameter below about 150μ.

Eight lbs. of damp fabrics containing a total of ca. 12 lbs. of water and stained with miscellaneous food stains are placed in an automatic dryer at ambient temperature. The fabrics are spread out uniformly on the bottom of the dryer drum. 25 Grams of the composition of Example II are placed in a pouch fashioned from open pore polyurethane having a density of 1.2 lbs./cu. ft. and a wall thickness of ¼ in. The pouch is sealed with a plastic clip and placed on top of the damp fabrics. The dryer is operated at an average temperature of 60° C., with tumbling for 60 minutes. During this time, the bleaching composition sifts onto all fabric surfaces in a uniform manner. The fabrics are removed from the dryer and the food stains are found to be evenly and uniformly bleached.

The bleaching composition of Example II is replaced by an equivalent amount of ammonium perborate and TAGU at a 1:1 weight ratio; a 1:1:1 wt. mixture of sodium perborate, TAGU, and p-methoxyperbenzoic acid; a 1:1:1: wt. mixture of sodium perborate, *Oxone*, and TAGU; and chlorinated trisodium phosphate, respectively, and equivalent bleaching results are secured.

In the procedure of Example II the polyurethane foam pouch is replaced by a cotton bag woven to provide 200μ openings along one side of the bag. The bleach is evenly dispensed onto the fabrics and even, effective bleaching is secured.

In the foregoing procedure, the bleaching composition is replaced by equivalent perborate/TAGU bleaches having particle diameters of 50μ, 100μ and 175μ, respectively and even, effective bleaching is secured.

As can be seen from the foregoing, the bleaching process herein takes advantage of the fact that fabrics which are laundered and spun dry in an automatic washer retain from 25% to 300% by weight of water, based on total fabric weight. The bleaching compositions used in the process herein are formulated as small particles which rapidly dissolve in the water available from the damp fabrics. The resulting concentrations of bleach at the fabric surface, i.e., at the site of the stains, is quite high. For the peroxygen bleaches herein, from about 300 ppm to about 5000 ppm of available $O_2$ per gram of fabric are provided, and this high concentration of bleach effectively removes a wide variety of fabric stains.

What is claimed is:

1. A process for removing stains from fabrics in an automatic clothes dryer during the drying cycle comprising the steps of:

(1) tumbling damp fabrics at a temperature of from 50° C. to 80° C. in the clothes dryer; and (2) uniformly distributing an effective amount of a solid particulate bleaching composition consisting essentially of a peroxygen bleach having an average particle diameter below about 200 microns onto the damp fabrics within the first 10 minutes to 15 minutes of the drying cycle such that the bleaching composition is able to act in the presence of water on the damp fabrics prior to evaporation of the water from the fabrics.

2. A process according to claim 1 wherein the bleaching composition consists essentially of a peroxygen bleach and a peroxygen bleach activator.

3. A process according to claim 2 wherein the bleaching composition consists essentially of a bleach selected from the group consisting of alkali metal perborates and ammonium perborate, and the activator is 1,3,4,6-tetra-acetyl glycouril.

4. A process according to claim 3 wherein the weight ratio of perborate:1,3,4,6-tetra-acetyl glycouril is in the range of from 1:3 to about 30:1.

5. A process according to claim 1 wherein the bleaching composition comprises from about 1 part to about 10 parts by weight of sodium perborate and from about 2 parts to about 1 part by weight of 1,3,4,6-tetra-acetyl glycouril.

6. A process according to claim 1 wherein the bleaching composition is evenly distributed on the damp fabrics by a dispensing means.

7. A process according to claim 6 wherein the dispensing means comprises a water-insoluble, closed, flexible, porous pouch.

8. A process according to claim 1 wherein the bleaching composition has an average particle diameter of from about 25 microns to about 175 microns.

* * * * *